United States Patent [19]

Tone

[11] Patent Number: 5,058,817

[45] Date of Patent: Oct. 22, 1991

[54] APPARATUS FOR CONTROLLING ROTATION OF DRUM

[75] Inventor: Shoichi Tone, Kyoto, Japan

[73] Assignee: Murata Kikai Kabushiki Kaisha, Kyoto, Japan

[21] Appl. No.: 536,997

[22] Filed: Jun. 13, 1990

Related U.S. Application Data

[63] Continuation of Ser. No. 299,752, Jan. 23, 1989, abandoned.

[30] Foreign Application Priority Data

Jan. 25, 1988 [JP] Japan ..... 63-7046[U]

[51] Int. Cl.[5] ..... B65H 54/22

[52] U.S. Cl. ..... 242/36; 242/35.50 R; 242/35.50 A

[58] Field of Search ..... 242/36, 18 EW, 18 R, 242/35.5 A, 35.5 R, 35.6 R

[56] References Cited

U.S. PATENT DOCUMENTS

| | | | |
|---|---|---|---|
| 4,138,072 | 2/1979 | Aoyama et al. | 242/18 EW X |
| 4,526,326 | 7/1985 | Bloomfield et al. | 242/18 EW X |
| 4,630,782 | 12/1986 | Rohner | 242/18 EW X |
| 4,736,898 | 4/1988 | Raasch | 242/18 EW |
| 4,765,552 | 8/1988 | Sugioka et al. | 242/36 X |
| 4,768,728 | 9/1988 | Jenny et al. | 242/36 X |
| 4,805,846 | 2/1989 | Ueda et al. | 242/36 |

*Primary Examiner*—Stanley N. Gilreath

*Attorney, Agent, or Firm*—Spensley Horn Jubas & Lubitz

[57] ABSTRACT

An apparatus for controlling rotation of a drum comprises a controlling device which controls, upon winding, an invertor such that a motor for driving the drum which is adapted to be contacted with and rotate a package may be rotated at an optimum rotational speed in accordance with winding conditions of each of winding units of an automatic winder and which controls, upon doffing, the invertor such that rotation of a package which is effected in order to wrap an end of a yarn of a package around a bobbin may be carried out by the drum.

3 Claims, 2 Drawing Sheets

APPARATUS FOR CONTROLLING ROTATION OF DRUM

This is a continuation of application Ser. No. 07/299,752 filed on Jan. 23, 1989, now abandoned.

FIELD OF THE INVENTION

This invention relates to an apparatus for controlling rotation of a drum wherein, upon doffing of a fully wound package in an automatic winder, rotation of the package which is effected in order to wrap an end of the package around a bobbin is carried out by the drum.

RELATED ART STATEMENT

FIG. 2 shows a side elevational view of an automatic winder, and the automatic winder 1 is composed of a large number of juxtaposed winding units 2 and a traveling bogie 3 which moves along the individual units. Each of the winding units 2 has a package 4, a traverse drum 6 and so on. If the package 4 is fully wound up, then it is doffed by the traveling bogie 3, and thereupon, the package 4 is rotated in order to wrap an end of a yarn of the package around a bobbin.

Conventionally, rotation of the package upon doffing of the fully wound package is carried out by contacting an auxiliary roller 8, which is provided at an end of a pivotal arm 5 extending from the traveling bogie side and rotated by a driving member not shown, with the package 4. Upon such rotation, a yarn Y is guided by a support arm 9 and wrapped around a bobbin 7.

However, rotation by the conventional auxiliary roller 8 provides a drawback that, because the diameter and the contacting area of the auxiliary roller with a package are small, the package may be damaged due to the necessity of increasing the contacting pressure to rotate the package at a high speed or the package may not be rotated well.

Further, since the auxiliary roller, pivotal arm and so on must be provided for exclusive use, complication in structure is invited on the traveling bogie side.

OBJECT AND SUMMARY OF THE INVENTION

It is an object of the present invention to provide an apparatus for controlling rotation of a drum which is simple in structure and will not damage a package.

According to the present invention, an apparatus for controlling rotation of a drum comprises a controlling device which controls, upon winding, an invertor such that a motor for driving the drum which is adapted to be contacted with and rotate a package may be rotated at an optimum rotational speed in accordance with winding conditions of each of winding units of an automatic winder and which controls, upon doffing, the invertor such that rotation of a package which is effected in order to wrap an end of a yarn of a package around a bobbin may be carried out by the drum and the drum driving motor may be rotated at a low rotational speed.

As the drum which is used upon winding is used also upon doffing to rotate a package, a special package rotating roller for doffing becomes unnecessary. Further, since the diameter and the contacting area of the drum with the package are great, even if the drum is rotated at a low speed, an end of a yarn of the package can be sufficiently wrapped around a bobbin. Accordingly, the package will not be damaged nor insufficient rotation of the package will be caused.

DETAILED DESCRIPTION OF PREFERRED EMBODIMENT

In the following, an embodiment of the present invention will be described with reference to FIG. 1.

Figure 1:
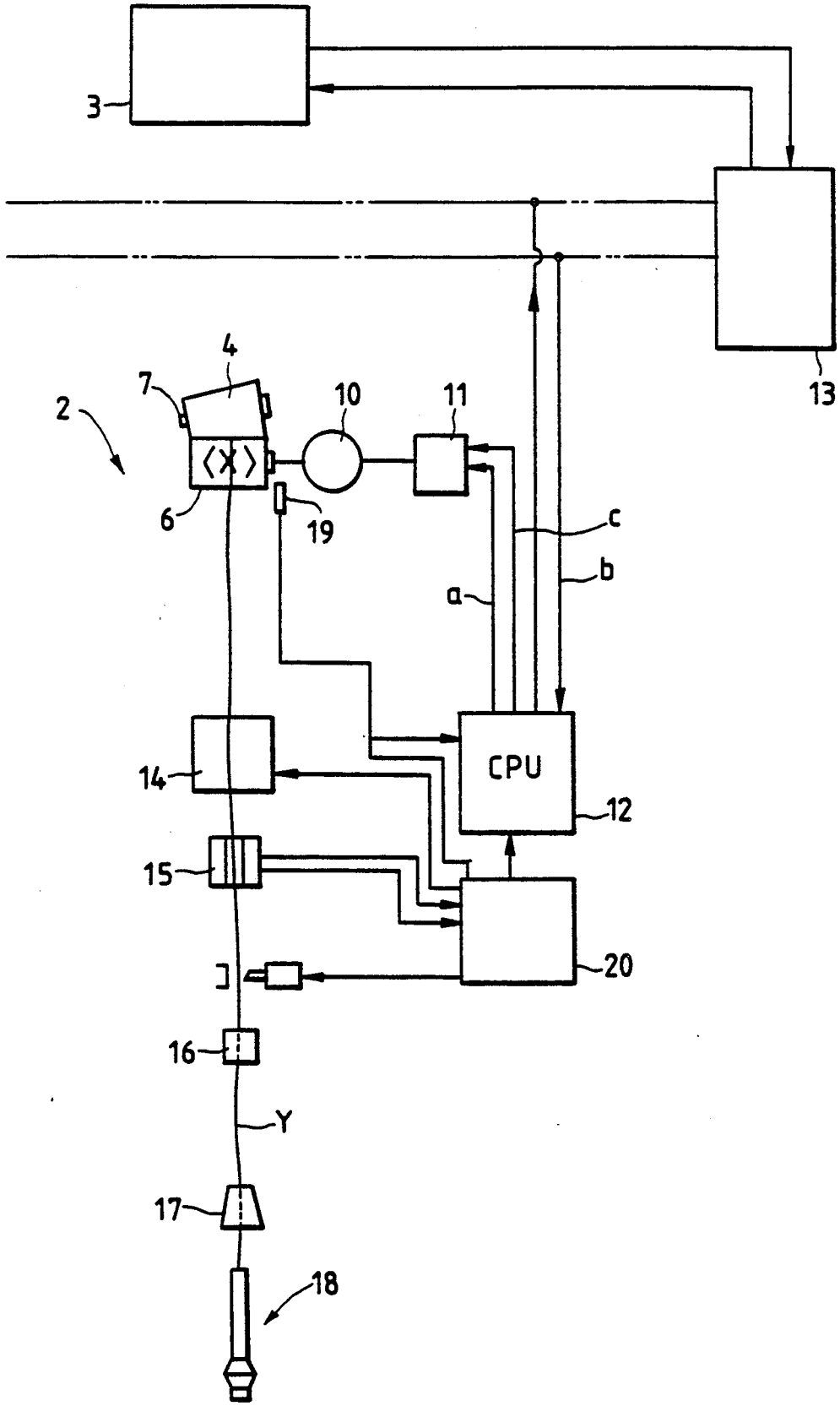
FIG. 1 is a constructional view showing an embodiment of apparatus for controlling rotation of a drum according to the present invention.
Figure 2:
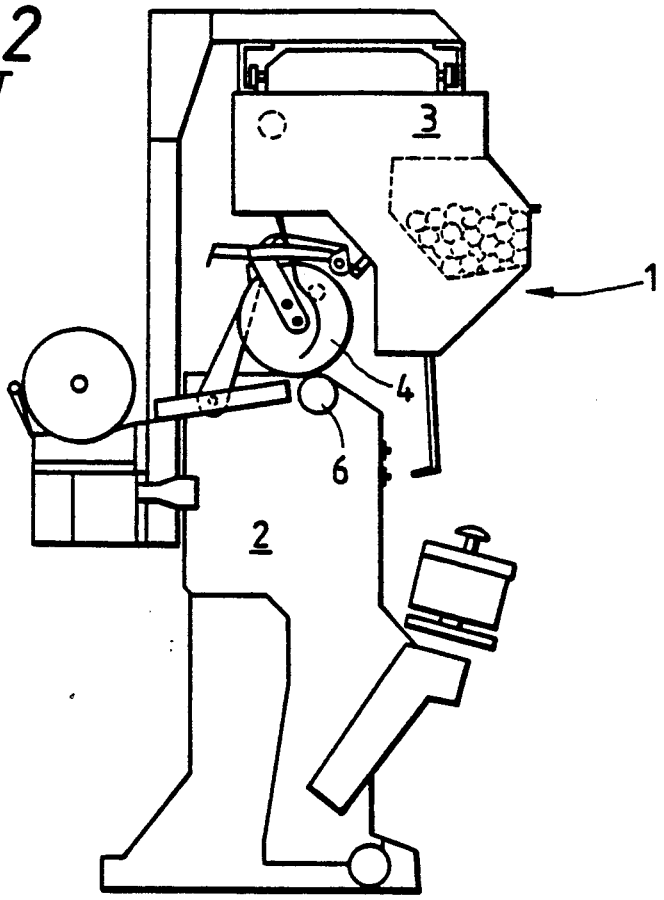
FIG. 2 PRIOR ART
FIG. 2 a schematic constructional view of an automatic winder.
Figure 3:
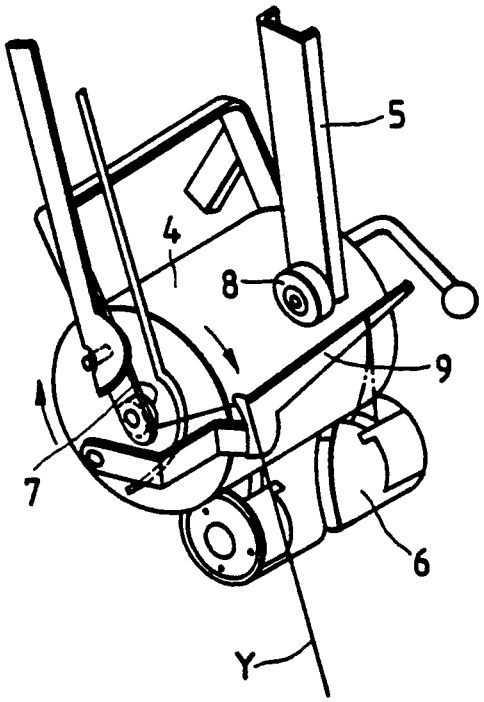
FIG. 3 PRIOR ART
FIG. 3 a perspective view of a yarn drawing aside device as viewed from its front.

FIG. 1 shows an example of apparatus for controlling rotation of a drum according to the present invention. A drum driving motor 10 for driving a drum 6 which is adapted to be contacted with and rotate a package 4 is provided on each of winding units 2 of an automatic winder, and rotational speed of the motor 10 is controlled by an invertor 11 which is provided similarly for each of the winding units. In particular, each of the winding units 2 is equipped with a control device 12 for controlling, upon winding, the motor 10 to rotate at a most suitable rotational speed for winding conditions of the winding unit, and rotational speed of the drum driving motor 10 is set by the invertor 11 in response to a control signal a delivered from the control device 12.

Meanwhile, the control device 12 has a function to control, upon doffing, the motor 10 to rotate the package 4 at a low speed by way of the drum 6, and rotational speed of the drum driving motor 10 is set by way of the invertor 11 in response to a rotation controlling signal c which is delivered from the control device 12 in response to a package rotating instruction b delivered from the traveling bogie 3 to the control device 12 by way of a central controlling device 13 at an end portion of a machine frame of the winder. An address sensor (not shown) which detects a position of a winding unit where the travelling bogie 3 is moved is provided on the travelling bogie 3. An information data of a position of the travelling bogie 3 (an information of a number of a winding unit) detected by the address sensor is delivered to the central controlling device 13 by means of an electric cable or an optical communication. The central controlling device 13 delivers a signal to open a signal gate of a subjected winding unit where the doffing operation is started based on the delivered information of the number of the winding unit. Accordingly, a signal for rotating the drum 6 at a low rotational speed in response to the timing of the doffing operation at the travelling bogie side can be input to the subjected winding unit. Even if the drum 6 is used to rotate the package 4 upon doffing, there is no trouble because originally the drum 6 is not used upon doffing.

Further, in the figure, reference symbol Y denotes a yarn, 14 a yarn splicing device, 15 a slub catcher, 16 a tension device, 17 a balloon breaker, 18 a fine spinning bobbin, and 19 a pulse generating device for detecting rotation of the traverse drum 4. Reference numeral 20 denotes a controller, and the controller 20 has a function to deliver a stopping instruction for the traverse drum driving motor 10 to the controller 2 when yarn break is detected by the slub catcher 15 and some other functions Now, with such a construction as described above, if a package 4 on any of the units 2 is fully wound up, then the traveling bogie 3 moves to the position of the unit to perform drawing aside of a yarn in order to perform doffing. Rotation of the package which is effected upon such drawing aside of a yarn is carried out by the drum 6 which is controlled to rotate at a low speed by the invertor 11 in response to an instruction from the traveling bogie 3.

Accordingly, since the package can be rotated stably in a quite similar manner as upon winding, an end of a yarn of the package can be wrapped with certainty around a bobbin. Besides, since the contacting pressure is not localized, wrapping of the yarn end can be attained without damaging the package According to the present invention, since rotation of a package upon doffing is carried out making use of a drum, a package rotating roller for exclusive use for doffing becomes unnecessary, and simplification of the structure can be attained. Further, since the package is rotated by the drum, the package will not be damaged.

What is claimed is:

1. In an automatic winder having a plurality of winding units for winding a plurality of yarn packages, at least one of the winding units having a rotatable drum adapted to contact and rotate the yarm package, an apparatus for controlling the rotational speed of the drum during winding of the yarn package and during doffing of the yarn package, the apparatus comprising:

a travelling bogie for doffing the yarn package, the travelling bogie having a signal means for providing a signal, a motor for driving the drum, control means associated with the winding unit for generating first and second rotation controlling signals, invertor means for selectively controlling the speed of the motor in response to the first or second rotation controlling signal to thereby control the rotational speed of the drum, wherein the control means supplies the first rotation controlling signal to the invertor to control the rotational speed of the drum during winding, and the control means, responsive to the signal from the travelling bogie, supplies the second rotation controlling signal to the invertor to control the rotational speed of the drum during doffing of the yarn package.

2. The apparatus as claimed in claim 1, wherein the invertor means controls the speed of the motor such that the rotational speed of the drum during winding is greater than the rotational speed of the drum during doffing.

3. The apparatus as claimed in claim 1, further comprising:

central control means responsive to the signal from the travelling bogie for generating a package rotating instruction and for transmitting the package rotating instruction to the control means associated with the winding unit, wherein the control means generates the second rotation controlling signal in response to the package rotating instruction.

* * * * *